US007617742B2

(12) United States Patent
Radtke et al.

(10) Patent No.: US 7,617,742 B2
(45) Date of Patent: Nov. 17, 2009

(54) FLOW THROUGH IN SITU REACTORS WITH SUCTION LYSIMETER SAMPLING CAPABILITY AND METHODS OF USING

(75) Inventors: Corey W. Radtke, Idaho Falls, ID (US); D. Brad Blackwelder, Blackfoot, ID (US); Joel M. Hubbell, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 452 days.

(21) Appl. No.: 11/424,004

(22) Filed: Jun. 14, 2006

(65) Prior Publication Data

US 2007/0289372 A1 Dec. 20, 2007

(51) Int. Cl.
*G01N 1/22* (2006.01)

(52) U.S. Cl. ..... 73/863.23

(58) Field of Classification Search ..... None
See application file for complete search history.

(56) References Cited

U.S. PATENT DOCUMENTS

| | | | | |
|---|---|---|---|---|
| 1,896,703 | A | 2/1933 | Dean | |
| 3,047,081 | A | 7/1962 | Pitcher | |
| 3,447,615 | A | 6/1969 | Schick | |
| 3,497,018 | A | 2/1970 | Schultz et al. | |
| 3,530,933 | A | 9/1970 | Whitten | |
| 3,696,873 | A | 10/1972 | Anderson | |
| 4,043,407 | A | 8/1977 | Wilkins | |
| 4,081,040 | A | 3/1978 | Henson | |
| 4,588,036 | A | 5/1986 | Desrochers et al. | |
| 4,618,396 | A * | 10/1986 | Shimoda et al. | 252/62.3 E |
| 4,860,599 | A | 8/1989 | Griffis | |
| 4,863,593 | A * | 9/1989 | Quick | 210/136 |
| 5,000,051 | A * | 3/1991 | Bredemeier | 73/863.23 |
| 5,010,776 | A | 4/1991 | Lucero et al. | |
| 5,035,149 | A * | 7/1991 | Wierenga | 73/863.23 |
| 5,058,688 | A | 10/1991 | Scott et al. | |
| 5,101,917 | A | 4/1992 | Abdul et al. | |
| 5,341,692 | A | 8/1994 | Sher et al. | |
| 5,348,422 | A | 9/1994 | Manchak, III et al. | |

(Continued)

FOREIGN PATENT DOCUMENTS

GB 2276897 A 10/1994

OTHER PUBLICATIONS

"Ground Water Clean-up Using In-Situ Bioremediation," Geo/Environmental Associates, Inc., 2000, pp. 1-5. http:// www.geo.com/special%20Projects/In-Situ%20Bioreactor.htm, Printed Sep. 24, 2001.

(Continued)

*Primary Examiner*—Robert R Raevis
(74) *Attorney, Agent, or Firm*—TraskBritt

(57) ABSTRACT

An in situ reactor for use in a geological strata includes a liner defining a centrally disposed passageway and a sampling conduit received within the passageway. The sampling conduit may be used to receive a geological specimen derived from geological strata therein and a lysimeter is disposed within the sampling conduit in communication with the geological specimen. Fluid may be added to the geological specimen through the passageway defined by the liner, between an inside surface of the liner and an outside surface of the sampling conduit. A distal portion of the sampling conduit may be in fluid communication with the passageway.

22 Claims, 12 Drawing Sheets

U.S. PATENT DOCUMENTS

| | | | | |
|---|---|---|---|---|
| 5,372,208 | A | 12/1994 | Mefferd | |
| 5,465,628 | A * | 11/1995 | Timmons | 73/864.34 |
| 5,710,361 | A | 1/1998 | Harrington et al. | |
| 5,813,461 | A | 9/1998 | Theisen | |
| 5,889,217 | A | 3/1999 | Rossabi et al. | |
| 5,931,237 | A | 8/1999 | Henke et al. | |
| 5,979,569 | A | 11/1999 | Heller | |
| 6,000,481 | A | 12/1999 | Heller et al. | |
| 6,203,703 | B1 | 3/2001 | Yerushalmi et al. | |
| 6,305,482 | B1 | 10/2001 | Aumann et al. | |
| 6,401,547 | B1 * | 6/2002 | Hatfield et al. | 73/861.04 |
| 6,609,434 | B2 | 8/2003 | Hubbell et al. | |
| 6,681,872 | B2 | 1/2004 | Radtke et al. | |
| 6,742,405 | B2 | 6/2004 | Hubbell et al. | |
| 6,826,972 | B2 | 12/2004 | Clark et al. | |
| 6,938,503 | B2 | 9/2005 | Clark et al. | |
| 2003/0196498 | A1 * | 10/2003 | Hubbell et al. | 73/863.23 |

OTHER PUBLICATIONS

"In-Situ Microbial Filters," LLNL Bioremediation Technologies, Jun. 18, 2001, pp. 1-5, Wysuwyg://202/http://www.llnl.gov/ees/aet/biofilt/biofilthtml, Printed Sep. 24, 2001.

* cited by examiner

FLOW THROUGH IN SITU REACTORS WITH SUCTION LYSIMETER SAMPLING CAPABILITY AND METHODS OF USING

CONTRACTUAL ORIGIN OF THE INVENTION

This invention was made with government support under Contract No. DE-AC07-05ID14517 awarded by the United States Department of Energy. The government has certain rights in the invention.

BACKGROUND OF THE INVENTION

1. Field of the Invention

The present invention relates to flow through in situ reactors with suction lysimeter sampling capabilities for use in geological strata such as various subsurface soils, sediment, or other matrix, and more specifically to in situ reactors that are useful to evaluate environmental conditions required to remediate potential hazardous conditions that may occur in the soil and groundwater. The present invention is also directed to methods of using an in situ reactor with suction lysimeter sampling capabilities.

2. State of the Art

The costs associated with testing for various contaminants in soil and aquifers are well known. In situ assessment technology conventionally provides data on one treatment with respect to a contaminant. Replication of earlier testing is usually done at exorbitant monetary costs. The impact of conventional testing techniques to detect, for example, groundwater contamination has other environmental impacts on a given area and there is usually no guarantee regarding the accuracy of the resulting data. Investigators and engineers use costly laboratory tests to evaluate the efficacy of future and on-going remedial treatments.

While laboratory tests are more extensively used, these studies are also more expensive to perform and may produce ambiguous or inaccurate data because of the consequences associated with excessive soil disruption. These same laboratory tests provide no assurances that the same process will be found applicable in actual field conditions. For example, experiments that are run in a conventional manner on soil specimens or water extracted from soil specimens are not run under real time, and field conditions will not be accurately represented. Field temperatures, including temperature trends over time, will not be accurately reflected and field barometric pressures (as impacted by the in situ geology, hydrology, and stratigraphy) are not reflected. In addition, compaction and layering in the laboratory samples will impact the representiveness of the tests. Therefore, the results are questionable.

In investigating various soil contamination, it is sometimes advisable to test proposed remediation while the soil specimen remains in hydraulic contact with the underlying subsurface aquifer. Likewise, it is desirable to be able to sample the water within the pores of the soil specimen. The water in the pores is known as the soil pore water.

Conventional techniques do not allow soil specimens to maintain their biofilms and soil structures in an intact state while both the soil specimen and the soil pore water are being tested for various contamination. In this regard, traditional techniques (removing the soil for laboratory testing) have introduced reactive sites to the soil. The soil is disturbed in order to remove it for laboratory testing. Disturbing the soil may result in disturbing the various microbial communities found in the soil column. Therefore, the results of such testing are highly questionable when microbial communities are relevant to the remediation treatment being considered for a given geological strata.

One region of interest in a geological strata is a subsurface region known as the vadose zone, a region of variably saturated or unsaturated soil, sediment and rock. Water and contaminants may move through the vadose zone and eventually end up in the groundwater. Therefore, information regarding the contaminants in the vadose zone is valuable for appropriate waste treatment. A suction lysimeter is one hydrological instrument useful for sampling liquids in soil and other geological substrates, including soil in the vadose zone. There are several types of lysimeters, and the term "lysimeter" as used herein, refers to a suction lysimeter. Liquid may be drawn to the suction lysimeter using a vacuum or a pressure gradient or differential. A conventional suction lysimeter may include a filter or membrane arrangement such that undesired particulates, solids or gases are not collected with the desired sample liquid.

The sample liquid may be present in very thin layers, or the material to be sampled might be unsaturated (the pores of the material are not filled to capacity with water). If the desired liquid is not flowing freely, or held in place by capillary forces, the use of vacuum or hydraulic gradient forces may be required to overcome the capillary action and obtain the desired liquid sample. This may be required in both saturated and unsaturated sample regions.

In U.S. Pat. No. 6,681,872 to Radtke et al., an in situ reactor is described that may be placed in a borehole formed in geological strata, and receive a geological specimen derived from the geological strata. Fluids may be applied to the geological specimen to perform various experiments; however, liquid samples from the geological specimen may not be removed while the geological specimen resides in the vadose zone. In particular, liquid samples from unsaturated specimens may be desired, but may not be removed.

Therefore it would be advantageous to provide an in situ reactor with suction lysimeter sampling capabilities.

BRIEF SUMMARY OF THE INVENTION

One embodiment of the present invention provides an in situ reactor for use in a geological strata, including a liner defining a centrally disposed passageway that is placed in a borehole formed in the geological strata, and a sampling conduit received within the passageway defined by the liner. The sampling conduit is in fluid communication with the passageway defined by the liner, and may receive a geological specimen that is derived from the geological strata. A suction lysimeter, comprising a reservoir at least partially defined with a porous membrane, is disposed within the sampling conduit. The porous membrane of the suction lysimeter may be planar or cup-shaped. Alternatively, the suction lysimeter may be an elongated annular member with a cylindrical tip. The porous membrane may be formed of, for example, ceramic or stainless steel.

The in situ reactor may additionally include a fluid coupler that is borne by the liner and in fluid communication with both the liner and the sampling conduit. The fluid coupler may have a main body, which defines a cavity, and which further releasably mates with the liner. The main body of the fluid coupler may additionally have a first fluid passageway in fluid communication with the liner, and a second fluid passageway in fluid communication with the sampling conduit.

The suction lysimeter may include at least one conduit for delivery of a sampled fluid, the conduit at least partially disposed within the second fluid passageway of the fluid coupler. A vacuum may be drawn on the conduit to draw the sampled fluid into the reservoir, and deliver the sampled fluid through the conduit to an alternate location to be tested, for example, above ground. In one embodiment, the suction lysimeter may include a second conduit operable for introducing positive or negative air pressure on the reservoir to draw the sampled fluid into the reservoir and push the sampled fluid up through the conduit.

In yet another alternative, the suction lysimeter may include at least one conduit at least partially disposed within an aperture through the main body of the fluid coupler for delivery of a sampled fluid. A second conduit may be included for applying positive or negative air pressure to the reservoir.

In yet another embodiment of the present invention, a method of testing the effect of a treatment on a contaminant in a geological strata includes positioning an in situ reactor within the geological strata by applying a force to the in situ reactor, which comprises a liner and a sampling conduit disposed concentrically therewithin, and driving the liner and the sampling conduit in unison to a depth. A geological specimen that is derived from the geological strata may be received within the sampling conduit, and a suction lysimeter comprising a reservoir and a porous membrane may be situated within the sampling conduit, wherein the porous membrane is in contact with the geological specimen. Another suction lysimeter may be positioned within the geological strata, at a location adjacent the in situ reactor. At least a first sample of a fluid of the geological specimen may be taken with the suction lysimeter, and at least a first sample of a fluid of the geological strata may be taken with another suction lysimeter. A treatment fluid may be introduced to the geological specimen, then at least a second sample of the fluid of the geological specimen may be taken with the suction lysimeter, and at least a second sample of the fluid of the geological strata may be taken with the another suction lysimeter.

Introducing the treatment fluid to the geological specimen may include introducing the treatment fluid through a first fluid passageway within a fluid coupler, the fluid coupler being borne by the liner and having a second fluid passageway in communication with the sampling conduit. Taking at least the first sample of a fluid may comprise transporting the first sample through a sipper conduit disposed within the second fluid passageway of the fluid coupler. Transporting the first sample through the sipper conduit may comprise drawing the first sample through the sipper conduit using a vacuum. Alternatively, transporting the first sample through the conduit may comprise forcing the first sample through the sipper conduit using positive pressure introduced through an air conduit in fluid communication with the sipper conduit.

In another embodiment of the present invention, an in situ reactor includes a liner having a main body defining a passageway therein, and a sampling conduit received within the passageway. The sampling conduit defines a reactor space that is operable to receive a geological specimen therein. The in situ reactor additionally includes a fluid coupler that is disposed with a first fluid passageway therethrough in fluid communication with the passageway defined by the liner, and a second fluid passageway in fluid communication with the reactor space of the sampling conduit. A suction lysimeter is disposed within the reactor space of the sampling conduit. The suction lysimeter includes a body, a porous membrane secured to the body, a reservoir defined by the body and the porous membrane, and a sipper tube in fluid communication with the reservoir and extending from the body through the second fluid passageway of the fluid coupler.

The porous membrane may comprise a substantially planar, round disc or be cup-shaped. Alternatively, the suction lysimeter body may be elongated, and include a conical tip. The suction lysimeter may additionally include an air conduit in fluid communication with the reservoir and extending from the body through the second fluid passageway of the fluid coupler.

Still another embodiment of an in situ reactor for use in a geological strata includes a body having an outside facing surface. The body may include a liner defining a passageway, a fluid coupler that is disposed with a first fluid passageway therethrough in fluid communication with the passageway defined by the liner, and a lysimeter including a porous membrane substantially contiguous with the outside facing surface. The in situ reactor may additionally include a sampling conduit received within the passageway, wherein the sampling conduit defines a reactor space that is operable to receive a geological specimen that is derived from the geological strata therein, the reactor space of the sampling conduit in fluid communication with a second fluid passageway through the fluid coupler. The lysimeter may be carried by the fluid coupler.

Other features and advantages of the present invention will become apparent to those of skill in the art through consideration of the ensuing description, the accompanying drawings, and the appended claims.

BRIEF DESCRIPTION OF THE DRAWINGS

The foregoing and other advantages of the invention will become apparent upon reading the following detailed description and upon reference to the drawings in which.

DETAILED DESCRIPTION OF THE INVENTION

Figure 1:
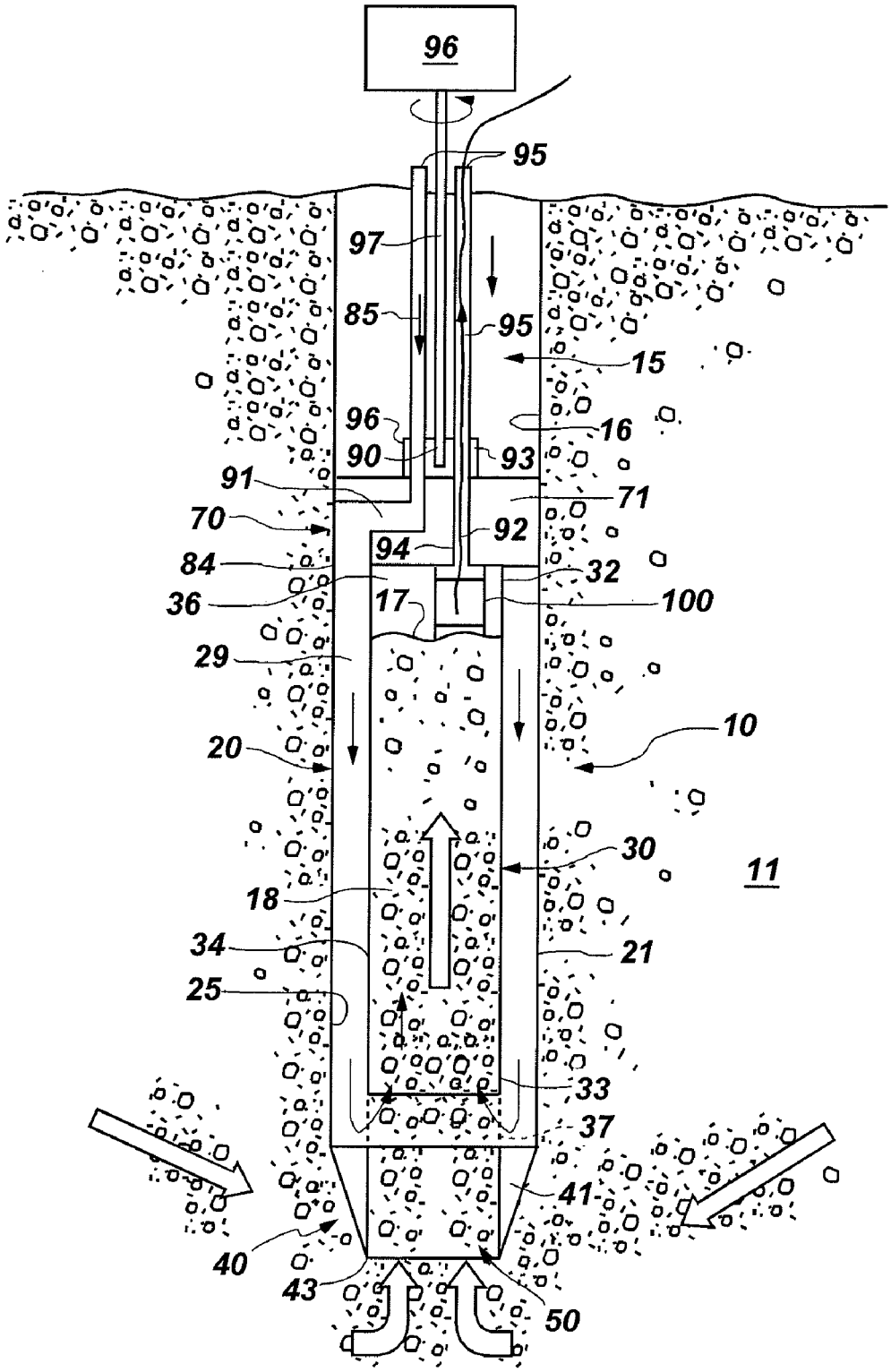
FIG. 1 shows an in situ reactor of the present invention employed at a location, in a borehole, below ground.

An in situ reactor 10 of the present invention is depicted in FIG. 1. The in situ reactor 10 may be employed in geological strata 11 such as various subsurface soils, sediment or other matrix for use in various testing regimens to facilitate remediation of existing soil and groundwater contamination. The in situ reactor 10 is deployed into a borehole 15, and operated from a position at or above ground to a position below ground. The borehole 15 may be a substantially cylindrical hole within the geological strata 11 formed using conventional methods, and is defined by a wall 16 and a bottom surface 17. The in situ reactor 10 is operable to internally receive a geological specimen 18 that is derived from the geological strata 11 and includes a top surface 17. The top surface 17 of the geological specimen 18 is the bottom surface 17 of the borehole 15.

Figure 5:
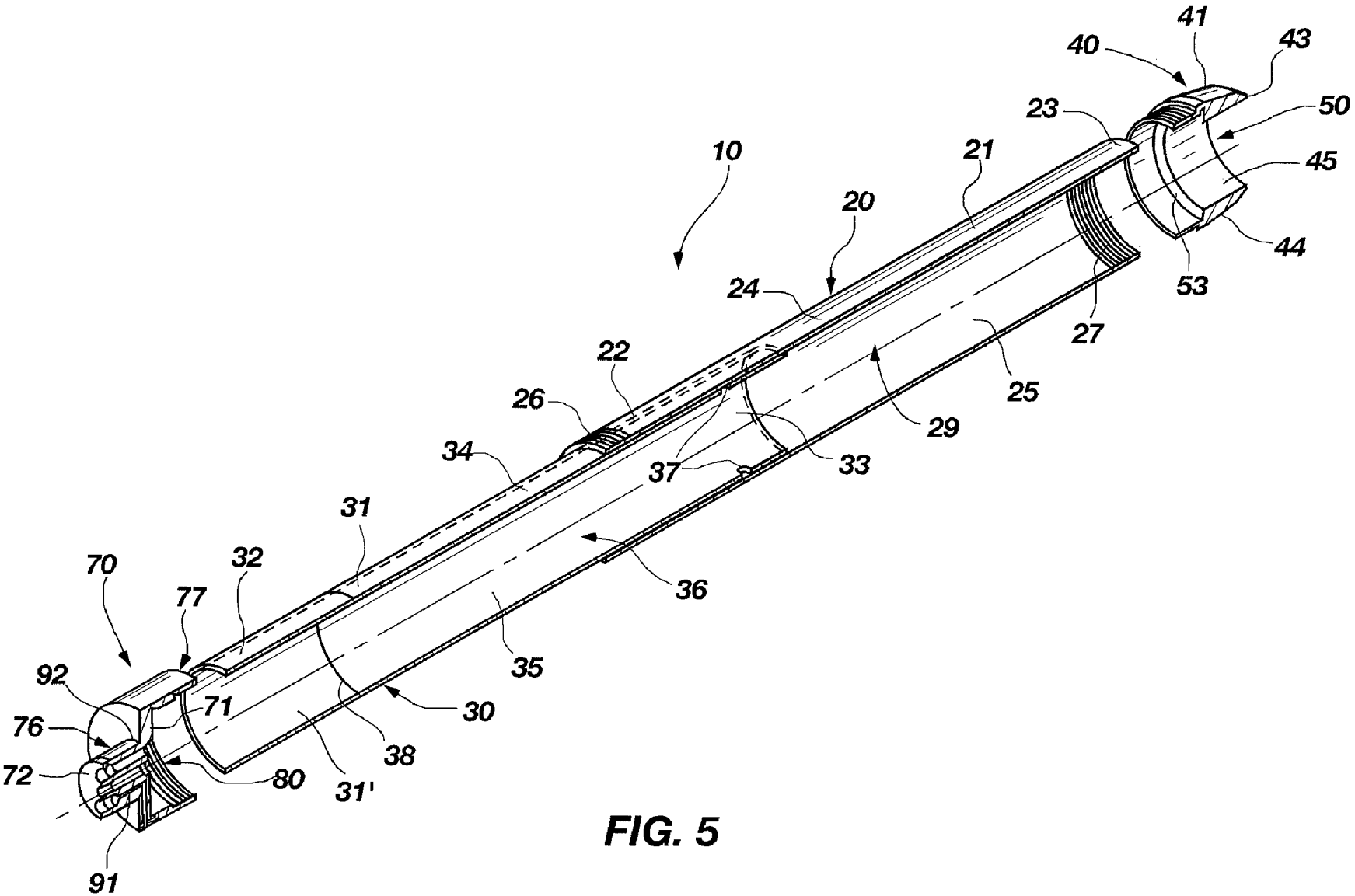
FIG. 5 is an exploded, perspective, cross-sectional view of portions of an in situ reactor of the present invention.

The in situ reactor 10 includes a liner 20 with a substantially cylindrically shaped main body 21 having a proximal end 22 and an opposite distal end 23 (FIG. 5). The main body 21 is defined by an outside facing surface 24, which has a diametral dimension that is less than the diametral dimension of the borehole 15, and further has an opposite inside facing surface 25 having a predetermined diametral dimension. As seen in FIG. 5, a first series of screw threads 26 may be formed in the outside facing surface 24, at the proximal end 22 of the main body 21. A second series of screw threads 27 may be formed in the inside facing surface 25 at the distal end 23 of the main body 21. The inside facing surface 25 defines a passageway 29.

The in situ reactor 10 additionally includes a sampling conduit 30, which has a substantially cylindrically shaped main body 31 located substantially concentrically within the passageway 29 defined by the liner 20. The main body 31 of the sampling conduit 30 has a proximal end 32, and an opposite distal end 33. The main body 31 of the sampling conduit 30 has a length dimension that is less than the length dimension of the main body 21 of the liner 20, enabling the sampling conduit 30 to be entirely concentrically contained within the liner 20. The main body 31 of the sampling conduit 30 has an outside facing surface 34, which has a diametral dimension that is less than the inside diametral dimension as defined by the inside facing surface 25 of the liner 20. As will be recognized, this dimensional relationship allows the sampling conduit 30 to be telescopingly received or otherwise nested within the passageway 29. As seen in FIGS. 1 and 5, this physical relationship provides a gap or space between the outside facing surface 34 and the inside facing surface 25. When concentrically positioned, a substantially annularly shaped passageway 29 is defined by this gap.

The sampling conduit main body 31 has an inside facing surface 35, which defines a reactor space 36 that extends between the proximal and distal ends 32 and 33 thereof. At least one aperture 37 is formed near the distal end 33 of the main body 31 thereby facilitating fluid flowing communication between the passageway 29 and the reactor space 36. The geological specimen 18 may be received within the reactor space 36.

Figure 2:
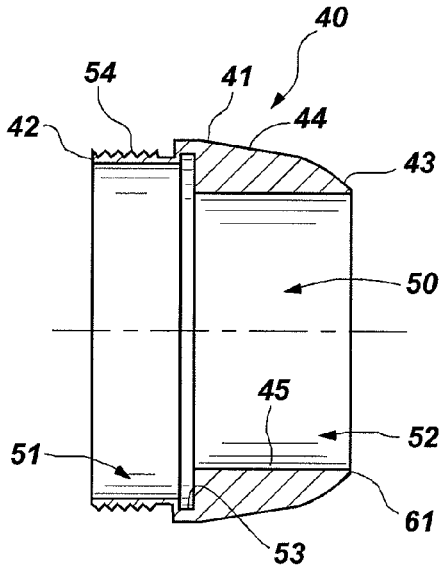
FIG. 2 is a longitudinal, vertical, sectional view of a geological strata engaging member of the in situ reactor of the present invention.
Figure 3:
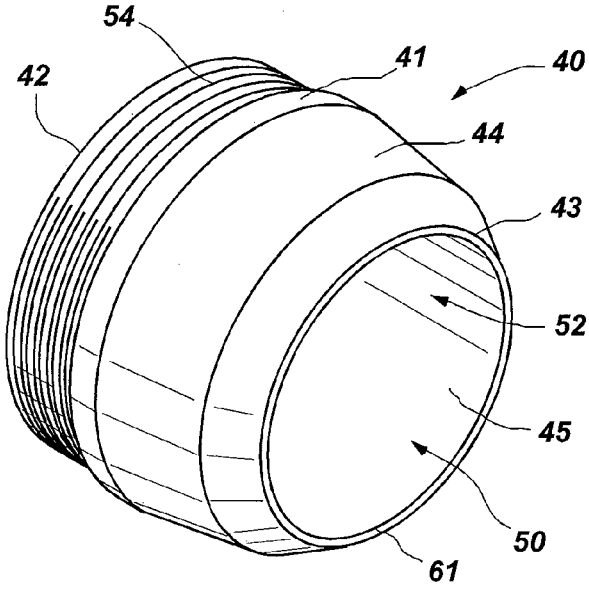
FIG. 3 a perspective, end view of the geological strata engaging member of FIG. 2.

Referring now to FIGS. 2 and 3, the in situ reactor 10 of the present invention may include a geological strata engaging member 40 mounted on the distal end 23 of the liner 20 (FIG. 5). The geological strata engaging member 40 has an annular-shaped main body 41 with a proximal longitudinal end 42 and an opposite, distal longitudinal end 43. The main body 41 of the geological strata engaging member 40 is defined by an outside facing surface 44 and an opposite inside facing surface 45. A passageway 50 through the geological strata engaging member 40 is defined by the inside facing surface 45. The passageway 50 includes a first portion 51 located near the proximal longitudinal end 42 thereof. The first portion 51 has a first inside diametral dimension defined by the inside facing surface 45. The passageway 50 has a second portion 52, which is concentrically located relative to the first portion 51, and which has an outside diametral dimension that may be less than the first portion 51 inside diametral dimension. An annularly shaped seat 53 is defined by the inside facing surface 45 and is located between the first and second portions 51 and 52. A series of screw threads 54 may be formed in the outside facing surface 44 at the proximal end 42. This series of screw threads 54 are operable to threadably mate with the series of screw threads 27, which are formed in the inside facing surface 25 at the distal end 23 of the liner 20 (FIG. 5). As will be recognized, this enables the main body 41 of the geological strata engaging member 40 to nest inside or otherwise be threadably mated and thus secured to the distal end 23 of the liner 20. Other methods of mating the geological strata engaging member 40 with the liner 20 are within the scope of the present invention.

The seat 53 may engage the distal end 33 of the sampling conduit 30 when the sampling conduit 30 is telescopically positioned within the liner 20. The inside diametral dimension of the first portion 51 of the geological strata engaging member 40 may be greater than the outside diametral dimension of the sampling conduit 30, enabling the distal end 33 of the sampling conduit 30 to fit telescopically therewithin. The diametral dimension of the second portion 52 of the geological strata engaging member 40 is less than or equal to the diametral dimension of the reactor space 36, which is defined by the inside facing surface 35 of the sampling conduit 30. Thus, the geological specimen 18 may be received within the passageway 50 of the geological strata engaging member 40 and the reactor space 36 of the sampling conduit 30.

The outside facing surface 44 of the geological strata engaging member 40 has a diminishing outside diametral dimension when measured in a direction from the proximal to the distal ends 42 and 43, respectively. As seen, this diminishing dimension appears tapering and somewhat generally frustoconical in shape. A cutting edge 61 may be formed at the distal end 43. The cutting edge 61 may be operable to facilitate the movement of the in situ reactor 10 through the geological strata 11. Alternatively, the cutting edge 61 may be scalloped, or the outside facing surface 44 of the geological engaging member 40 may include a geological strata engaging thread.

Figure 4:
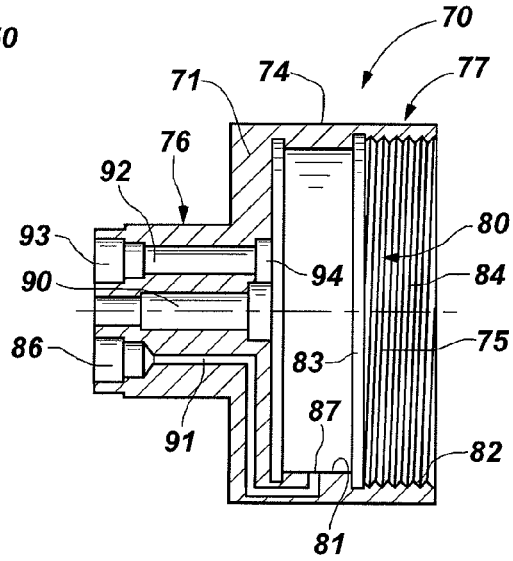
FIG. 4 is a longitudinal, vertical, sectional view of a fluid coupler of the in situ reactor of the present invention.

The in situ reactor 10 of the present invention may include a fluid coupler 70. The fluid coupler 70 may be releasably mounted on the proximal end 22 of the liner 20 and may sealably mate to the proximal end 32 of the sampling conduit 30. As seen in the longitudinal, vertical, cross-sectional view of FIG. 4, the fluid coupler 70 has a main body 71 defined by an outside facing surface 74, and an opposite inside facing surface 75. The outside facing surface 74 has first and second longitudinal portions 76 and 77 that have different diametral dimensions. The first portion 76 has an outside diametral dimension that is less than the outside diametral dimension of the second portion 77. A cavity 80 is defined by the inside facing surface 75 and is located generally within the second portion 77. The cavity 80 has a first portion 81 having a first inside diametral dimension, and a second portion 82 that has a second diametral dimension that is greater than the first inside diametral dimension. An annular seat 83 is formed into the inside facing surface 75. The annular seat 83 is operable to engage the proximal end 32 of the sampling conduit 30 when the in situ reactor 10 is assembled with the sampling conduit 30 received within the fluid coupler 70. A series of threads 84 may be formed in the inside facing surface 75 of the main body 71. The series of threads 84 are operable to threadably mate with the first series of screw threads 26 on the outside facing surface 24 of the liner 20. Other methods of coupling the fluid coupler 70 with the liner 20 are within the scope of the invention.

A releasable coupling passageway 90 within the fluid coupler 70 may be substantially centrally positioned relative to the first longitudinal portion 76 of the main body 71. Force may be applied by way of a push rod received in the passageway 90 to provide either linear or rotational force to the in situ reactor 10.

The main body 71 of the fluid coupler 70 defines first and second fluid passageways 91 and 92. Each of the first and second fluid passageways 91, 92 has a first end 86, 93, and an opposite, second end 87, 94. The second end 87 of the first fluid passageway 91 may be coupled in fluid communication with the annular passageway 29 between the inside facing surface 25 of the liner 20 and the outside surface 34 of the sampler conduit 30. The second end 94 of the second fluid passageway 92 may be coupled in fluid communication with the reactor space 36 within the sampling conduit 30. The first ends 86, 93 of the first and second fluid passageways 91, 92, respectively, may be coupled in fluid communication with conduits 85, 95 (FIG. 1), providing access to a position at or above ground.

Referring back to FIG. 1, the in situ reactor 10 may include a force application assembly 96 that applies force to the fluid coupler 70 by means of a push rod or member 97, which may be releasably mated with the releasable coupling passageway 90. The force application assembly 96 may be operable to apply linear, rotational, or/combinations of linear and rotational forces to the in situ reactor 10, enabling the in situ reactor 10 to be moved along or advanced in the borehole 15 and into contact with the geological strata 11. Upon further application of both either linear, rotational or both forces, the geological strata engaging member 40 may be urged into the bottom surface 17 of the borehole 15, thus resulting in the formation of a geological specimen 18 that moves into the reactor space 36.

Fluids of various types may be added by way of the first and second fluid passageways 91 and 92 in order to perform various experiments on the geological specimen 18 while the geological specimen 18 remains in hydraulic contact with the surrounding geological strata 11. As illustrated, fluid may be added to the in situ reactor 10 from a location above ground, by way of the conduit 85 and the first fluid passageway 91 and then withdrawn by way of the second fluid passageway 92 and another conduit 95 to the same location above ground. In the alternative, fluid may be added by way of the second fluid passageway 92 and withdrawn by way of the first fluid passageway 91 depending upon the desired testing.

A suction lysimeter 100 may be provided in association with the fluid coupler 70. The suction lysimeter 100, shown in detail in FIG. 6A, may include a porous membrane 110 through which subsurface liquids may be sampled. In use, the porous membrane 110 is in contact with the top surface 17 of the geological specimen 18. The porous membrane 110 may partially define a reservoir 120 in which sampled subsurface liquids 115 from the geological specimen 18 may collect. A lysimeter fluid conduit 130 may be coupled in fluid communication with the reservoir 120. The lysimeter fluid conduit 130 may enable the delivery of the sampled subsurface liquids 115 collected in the reservoir 120 to a location above ground for testing. A vacuum may be applied to the lysimeter fluid conduit 130 to draw the subsurface liquids 115 through the porous membrane 110 to collect in the reservoir 120 and then up the lysimeter fluid conduit 130. The lysimeter fluid conduit 130 may pass through the second passageway 92 of the fluid coupler 70 and through the conduit 95 as shown, or the fluid coupler 70 may include another aperture therethrough, which the lysimeter fluid conduit 130 may pass through, as shown with the double-tube suction lysimeter 200 of FIG. 7A, described hereinbelow.

Figure 6A:
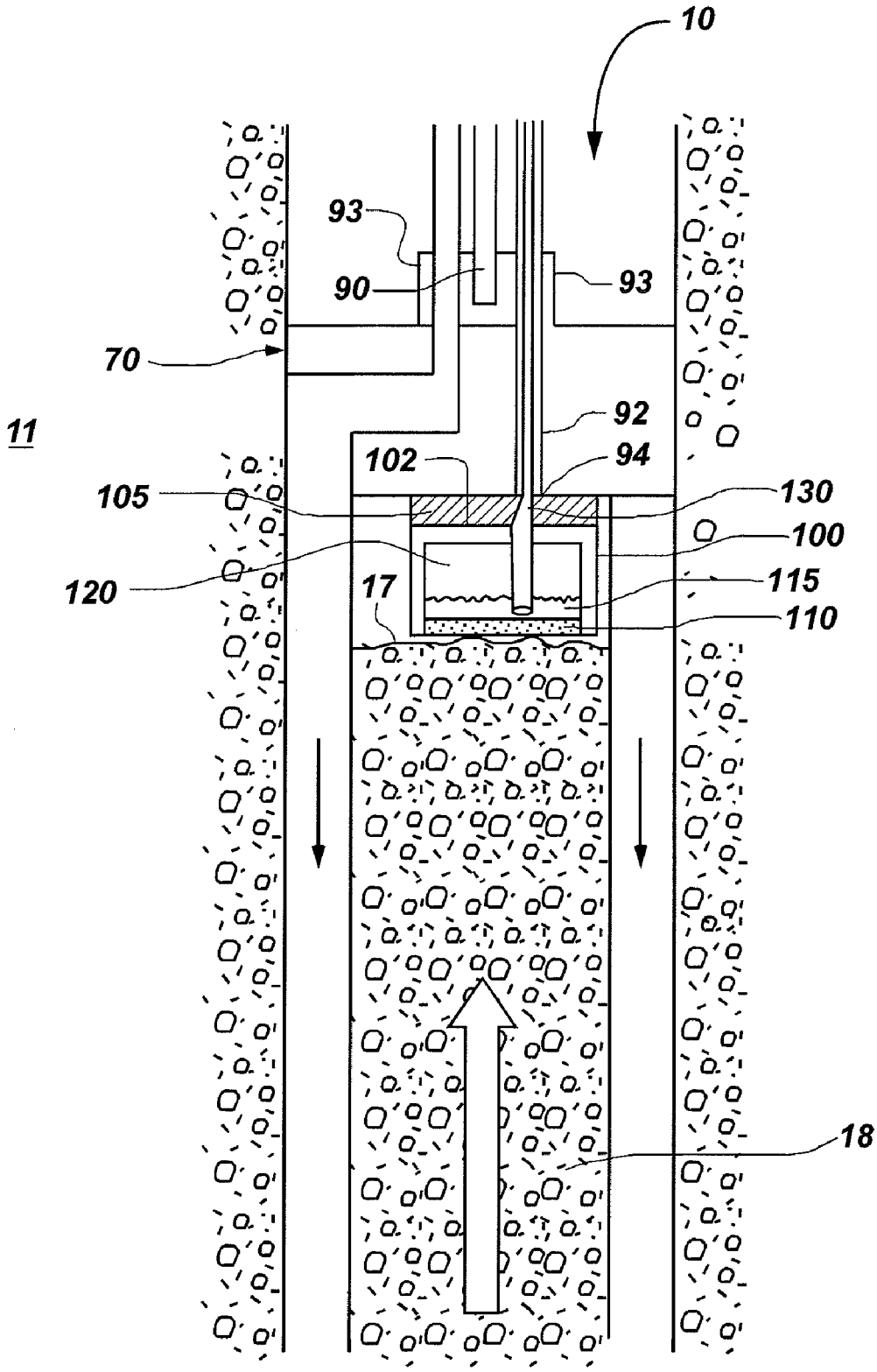
FIG. 6A is a close-up view of another embodiment of the in situ reactor of the present invention.
Figure 6B:
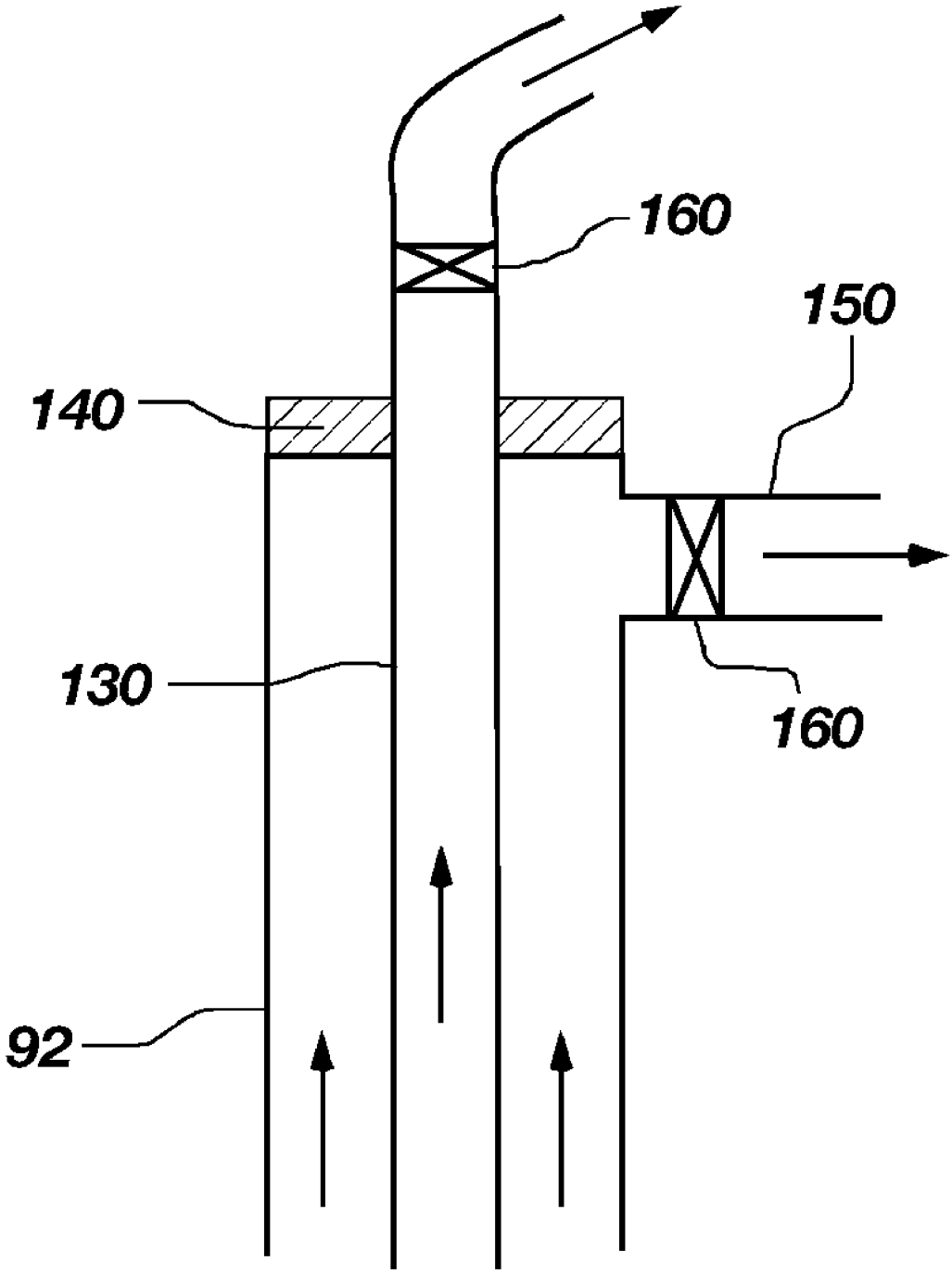
FIG. 6B is a close-up view of an above-ground portion of the in situ reactor of FIG. 6A.

Referring to FIG. 6B, the second fluid passageway 92 of the fluid coupler 70 may include a seal 140 about the lysimeter fluid conduit 130, enabling the fluids within the lysimeter fluid conduit 130 to be collected separately from the fluids of the second fluid passageway 92 of the fluid coupler 70. The seal 140 may be ring-shaped, encircling the lysimeter fluid conduit 130 and closing the top of the second fluid passageway 92 of the fluid coupler 70. A radially extending tube 150 may be in communication with the second fluid passageway 92 of the fluid coupler 70, enabling fluids therefrom to be collected. An operable sealing mechanism 160, for example a valve, may be operably connected with the lysimeter fluid conduit 130 and the radially extending tube 150, enabling fluid communication therethrough to be controlled.

Returning to FIG. 6A, the suction lysimeter 100 may be used to collect water in very thin layer of standing water, for example, less that one millimeter deep, or in unsaturated porous material. The porous membrane 110 may need to be prewetted to make a partial hydraulic connection to the geological specimen 18 if the geological specimen 18 is unsaturated. The porous membrane 110 may comprise a semi-permeable or porous material, for example, material having pores of between about 0.1 micron and about 14 microns in diameter. Pore sizes may vary with availability, attributes of the porous material and specific needs of the field tests. Suitable materials for the porous membrane include, but are not limited to, ceramic, plastic, glass, or metal such as stainless steel, and may be rigid or partially or wholly flexible. Other forms of porous material, such as a cluster of fibers capable of wicking a sample liquid into the reservoir 120, may also be used. The porous membrane 110 may be formed integrally with the reservoir 120 or secured in any appropriate manner, such as by bonding with an adhesive, such as glue or welding epoxy, securing with screws, or securing with a hose clamp or similar sealing mechanism.

In use, the porous membrane 110 is placed in hydraulic contact with the geological specimen 18. The contact is facilitated by pushing the in situ reactor 10 into the geological strata 11 until contact is achieved between the top surface 17 of the geological specimen 18 and the porous membrane 110. The suction lysimeter 100 may optionally include a semi-rigid layer 105 on a surface 102 thereof, proximate the fluid coupler 70. The semi-rigid layer 105 may be, for example, a spring, a sponge, a gasket such as a rubber gasket, or foam such as open cell foam. The semi-rigid layer 105 may be non-contiguous or porous, enabling fluid communication between the second fluid passageway 92 of the fluid coupler 70 and the reactor space 36 in the event that the suction lysimeter 100 is positioned therebetween. Alternatively, the suction lysimeter 100 may be positioned, and/or the fluid coupler 70 configured, such that fluid communication between the second fluid passageway 92 and the reactor space 36 is not blocked. The semi-rigid layer 105 may bias the suction lysimeter 100 toward the geological specimen 18. In yet another alternative, the suction lysimeter 100 may be constructed with sufficient weight to facilitate hydraulic contact between the top surface 17 of the geological specimen 18 and the porous membrane 110.

Figure 7A:
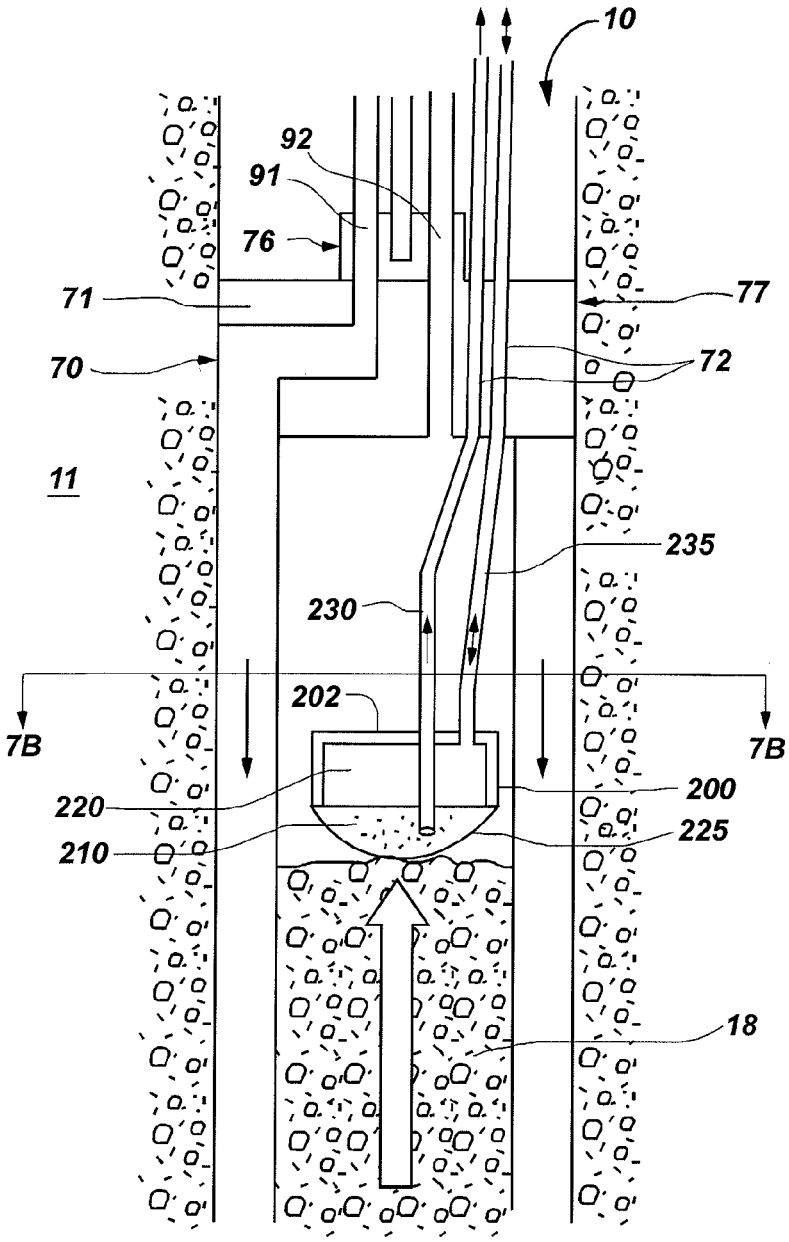
FIG. 7A is a close-up view of yet another embodiment of the in situ reactor of the present invention.

In another embodiment of the present invention, an in situ reactor 10 may include a double-tube suction lysimeter 200 as shown in FIG. 7A. The double-tube suction lysimeter 200 may include an air conduit 235 that extends from above ground to the top surface of the suction lysimeter 200. A sipper conduit 230 may extend into a lower region of the reservoir 220. A porous membrane 210 may at least partially form the lower surface 225 of the reservoir 220. A vacuum may be drawn on the air conduit 235 with the sipper conduit 230 sealed above ground to draw the subsurface liquids 115 through the porous membrane 210 and into the reservoir 220. Positive air pressure may then be applied to the reservoir 220 through the air conduit 235, forcing the liquid collected in the reservoir 220 up through the sipper conduit 230 to a higher elevation, for example above ground. Double-tube suction lysimeters are also known as "pressure/vacuum" lysimeters. The porous membrane 210 is shown to be cup-shaped, and the sampled subsurface liquid 115 may collect therein. The double-tube suction lysimeter 200 is shown with a curved porous membrane 210; however, it is within the scope of the present invention to have a double-tube suction lysimeter (FIG. 7A), or with a planar membrane as shown in FIG. 6A, or a single-tube suction lysimeter (FIG. 6A), or with a curved membrane as shown in FIG. 7A. The air conduit 235 and the sipper conduit 230 pass through apertures 72 within the fluid coupler 70. The apertures 72 are shown to pass through the second longitudinal portion 77 of the main body 71 of the fluid coupler 70. Apertures passing through the first longitudinal portion 76 and the second longitudinal portion 77 of the fluid coupler 70, parallel to the first and second fluid passageways 91, 92 of the fluid coupler 70 are also within the scope of the invention.

The double-tube suction lysimeter 200 is shown positioned at a distance from the fluid coupler 70. The double-tube suction lysimeter 200 may be weighted to ensure hydraulic contact with the geological specimen 18, or the double-tube suction lysimeter 200 may include a semi-rigid layer on a surface 202 thereof. The double-tube suction lysimeter 200 may be positioned adjacent the fluid coupler 70 and be biased toward the geological specimen 18 by pressure from the fluid coupler 70. In use, the in situ reactor 10 may be pushed into the geological strata 11 until the geological specimen 18 contacts the double-tube suction lysimeter 200 and is placed into hydraulic contact therewith.

Figure 7B:
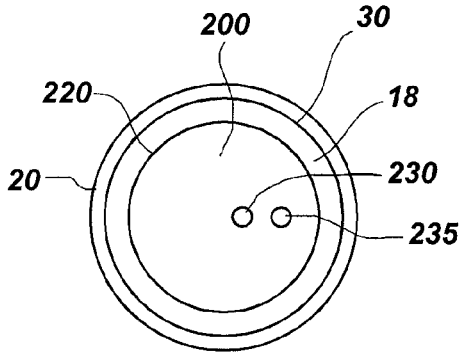
FIG. 7B is a cross-sectional view of the in situ reactor of FIG. 7A.

FIG. 7B depicts a cross-sectional view of the in situ reactor 10 shown in FIG. 7A. The cylindrical shape of the double-tube suction lysimeter 200 and the geological specimen 18 is apparent. The air conduit 235 and the sipper conduit 230 attach to the reservoir 220 in an off-center location, to facilitate the off-center location of the apertures 72 of the fluid coupler 70. Alternatively, the air conduit 235 and the sipper conduit 230 may be attached in a central location, and may be flexible to pass through the off-center apertures 72, or the air conduit 235 and the sipper conduit 230 may pass through the more centrally located second fluid passageway 92 of the fluid coupler 70.

Figure 8:
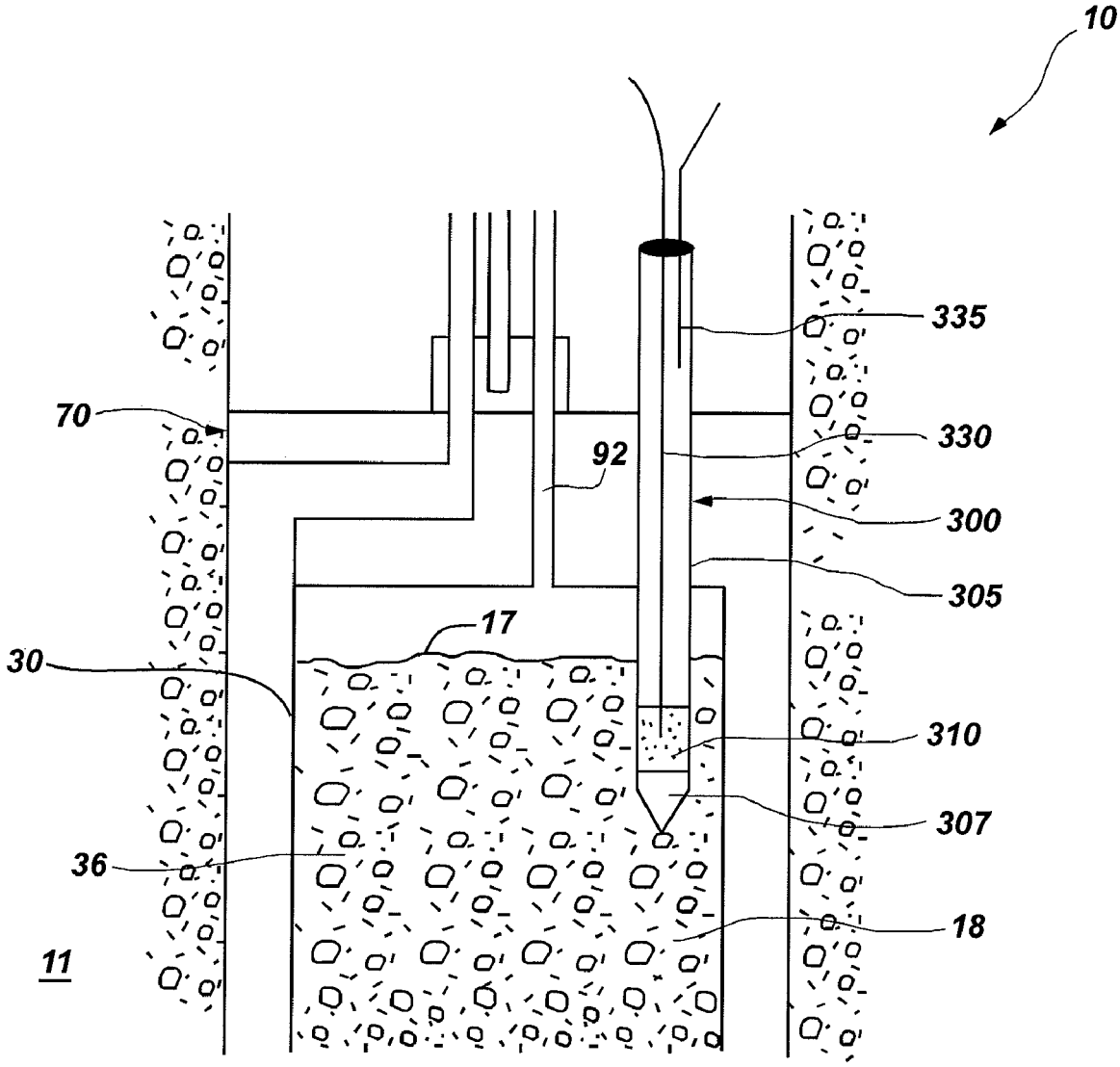
FIG. 8 is a close-up view of still another embodiment of the in situ reactor of the present invention.

FIG. 8 depicts a close-up view of an in situ reactor 10 that includes a spike-shaped suction lysimeter 300. The spike-shaped suction lysimeter 300 includes an elongated, annular body 305 with a porous membrane 310 at a distal end thereof. The porous membrane 310 may comprise a longitudinal portion of the body 305. A tip 307 of the spike-shaped suction lysimeter 300 may be conical in shape to enable the spike-shaped suction lysimeter 300 to be driven into the geological specimen 18. The spike-shaped suction lysimeter 300 may be rigidly attached the fluid coupling member 70. In use, the in situ reactor 10 may be driven into the geological strata 11. The geological strata engaging member 40 may separate the geological specimen 18 from the laterally adjacent geological strata 11. As the in situ reactor 10 is driven deeper, the geological specimen 18 partially fills the reactor space 36 within the sampling conduit 30. As the top surface 17 of the geological specimen 18 engages with the tip 307 of the spike-shaped suction lysimeter 300, additional force may be necessary to continue to drive the in situ reactor 10 deeper within the geological strata 11, and the distal portion of the body 305 of the spike-shaped suction lysimeter 300 into the geological specimen 18.

Alternatively, the spike-shaped suction lysimeter 300 may merely pass through an aperture through the fluid coupler 70, and not be rigidly attached thereto. In use, the in situ reactor 10 may be driven to the desired position in the geological strata 11, and the spike-shaped suction lysimeter 300 may be passed through the aperture through the fluid coupler 70, and driven into the geological specimen 18 thereafter.

The spike-shaped suction lysimeter 300 may be a double-tube suction lysimeter, with an air conduit 335 to alternate between a vacuum to draw liquids into the body 305 of the spike-shaped lysimeter 300 and positive pressure to force the sampled liquids up a sipper conduit 330. Alternatively, the spike-shaped suction lysimeter 300 may include a single fluid conduit to vacuum sampled liquids through the membrane 310 into the body 305 of the spike-shaped lysimeter 300 and up to the surface.

Figure 9A:
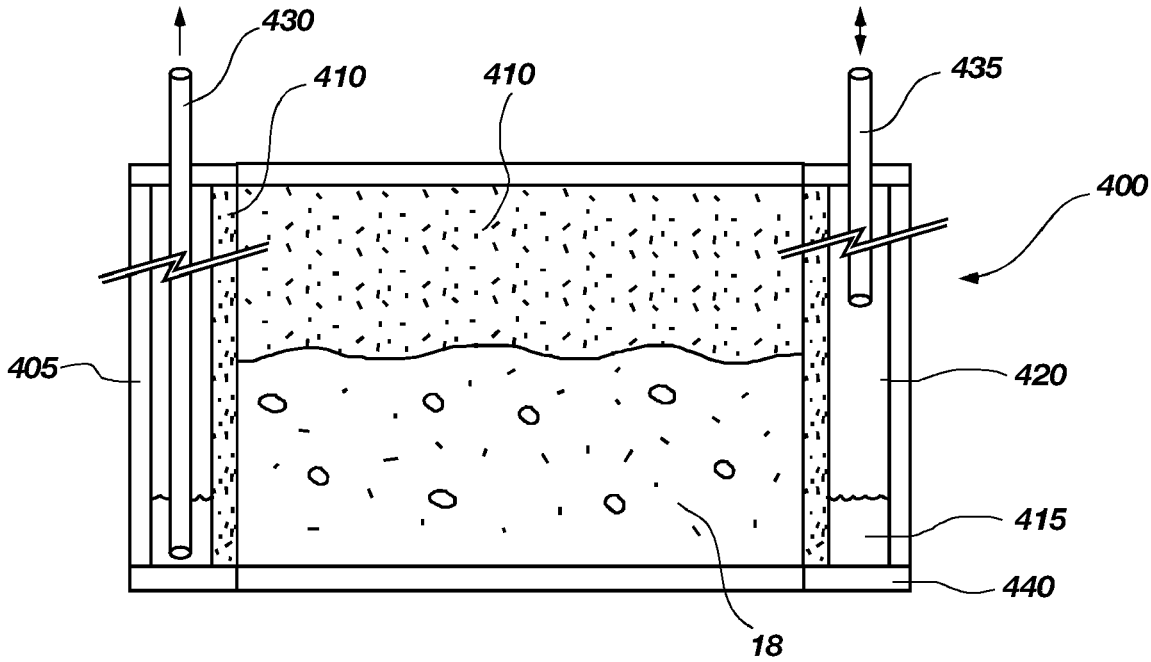
FIG. 9A is a close-up view of a longitudinal, vertical, cross-sectional view of another embodiment of the in situ reactor of the present invention.
Figure 9B:
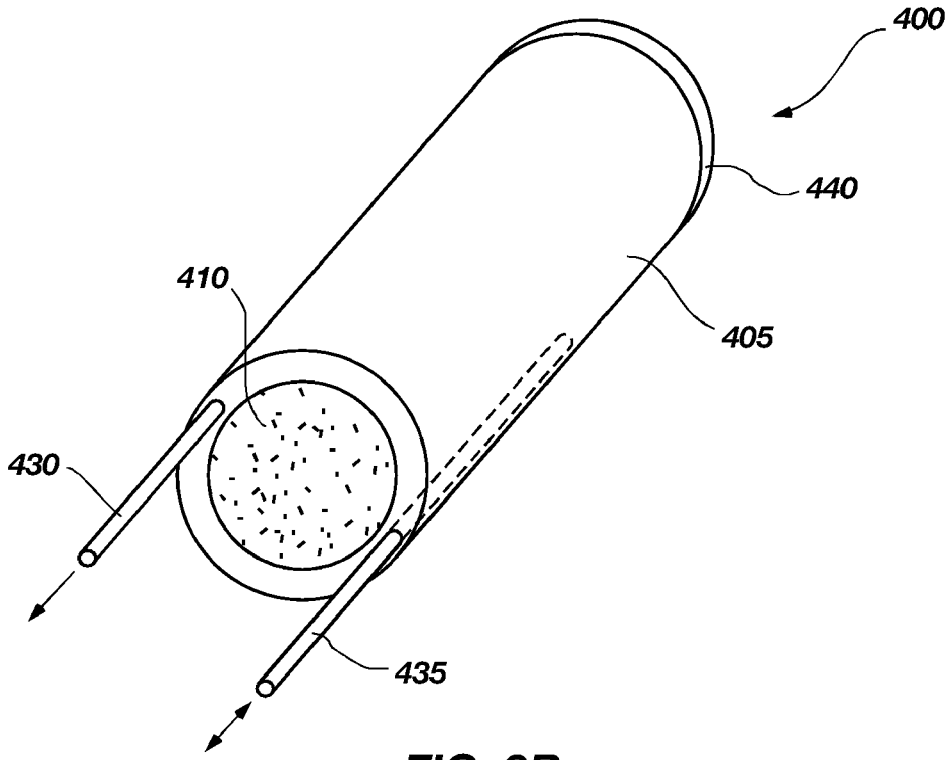
FIG. 9B is a perspective, end view of the in situ reactor of FIG. 9A.

FIG. 9A shows another suction lysimeter 400 that may be used in an in situ reactor of the present invention. The suction lysimeter 400 may be useful for collecting fluid samples from the geological specimen 18. The suction lysimeter 400 may be annular, as shown in FIG. 9B, and may replace a portion of the main body 31 of the sampling conduit 30. FIG. 5 shows a distal portion 31' of the sampling conduit main body 31, which may be replaced by the suction lysimeter 400. At a junction 38 between the suction lysimeter 400 and the main body 31 of the sampling conduit 30, a sealing element 440, such as an O-ring or a gasket may be provided.

The suction lysimeter 400 may comprise an inside wall 410 made of a porous material and an outside wall 405, which is nonporous. A gap, or reservoir 420, may be positioned between the inside wall 410 and the outside wall 405. In use, subsurface liquids 415 may pass through the porous inside wall 410 and collect in the reservoir 420. A lysimeter fluid conduit 430 may be coupled in fluid communication with the reservoir 420. The lysimeter fluid conduit 430 may enable the delivery of the sampled subsurface liquids 415 collected in the reservoir 420 to a location above ground for testing. A vacuum may be applied to the lysimeter fluid conduit 430 to draw the subsurface liquids through the porous inside wall 410 to collect in the reservoir 420 and then up the lysimeter fluid conduit 430.

The suction lysimeter 400 may optionally comprise a double-tube lysimeter, and include an air conduit 435, as shown. The air conduit 435 extends from above ground to an upper region of the reservoir 420. The lysimeter fluid conduit 430 may function as a sipper, and extend into a lower region of the reservoir 420. A vacuum may be drawn on the air conduit 435 to draw the subsurface liquids 415 through the porous inside wall 410 and into the reservoir 420. Positive air pressure may then be applied to the reservoir 420 through the air conduit 435, forcing the liquid collected in the reservoir 420 up through the lysimeter fluid conduit 430 to a higher elevation, for example, above ground. The lysimeter fluid conduit 430 and the air conduit 435 may pass through the first fluid passageway 91 of the fluid coupler 70 to a location above ground. Alternatively, another aperture may be provided through the fluid coupler 70 for communication to a higher elevation.

FIG. 9B depicts a perspective view of the annular, cylindrical, suction lysimeter 400. The inside wall 410 may have a diametrical dimension substantially similar to the inside facing surface 35 of the sampling conduit main body 31 of the sampling conduit 30, providing a continuous reactor space 36 therein. The outside wall 405 may have a diametrical dimension substantially similar to the outside facing surface 34 of the sampling conduit 30. The diametrical dimension of the outside wall 405 may be substantially similar to the inside facing surface 25 of the liner 20, and at least one conduit (not shown) through the suction lysimeter 400 may be provided for fluid communication between the annularly shaped passageway 29 and the second end 84 of the first fluid passageway 91.

Figure 10A:
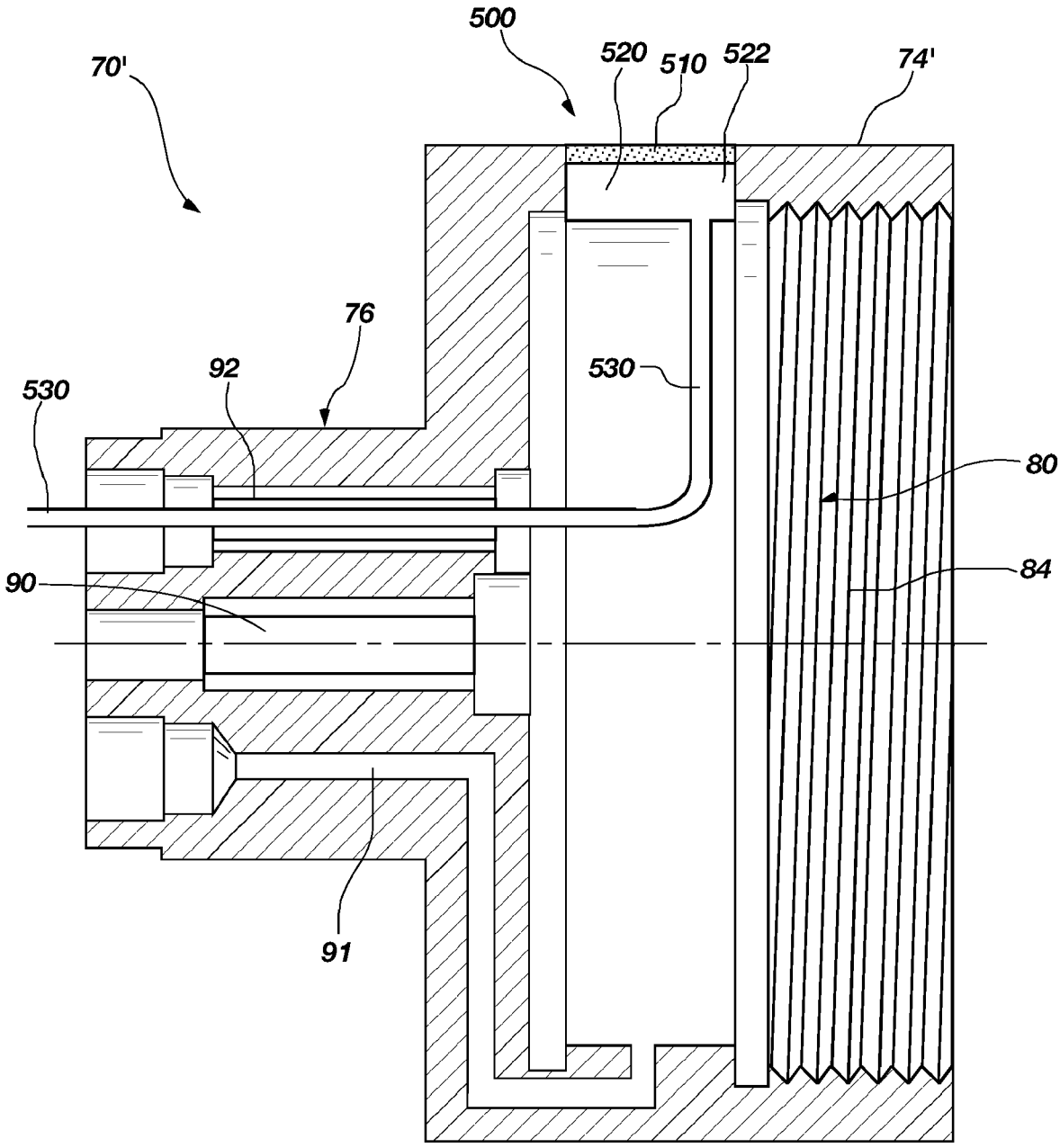
FIG. 10A is a close-up view of still another embodiment of the in situ reactor of the present invention.

FIG. 10A depicts a suction lysimeter 500 within a fluid coupler 70'. An in situ reactor 10 including the fluid coupler 70' may be useful for collecting liquid samples from the geological strata 11 surrounding the in situ reactor 10. The area surrounding the in situ reactor 10 may be untreated and useful for comparative purposes. The suction lysimeter 500 may include a porous membrane 510, substantially contiguous with an outside facing surface 74' of the fluid coupler 70'. A reservoir 520 may be positioned within the fluid coupler 70', with the porous membrane 510 comprising one boundary thereof. In use, subsurface liquids (not shown) may pass through the porous membrane 510 and collect in the reservoir 520. A lysimeter fluid conduit 530 may be coupled in fluid communication with the reservoir 520. The lysimeter fluid conduit 530 may enable the delivery of the sampled subsurface liquids collected in the reservoir 520 to a location above ground for testing. A vacuum may be applied to the lysimeter fluid conduit 530 to draw the subsurface liquids through the porous membrane 510 to collect in the reservoir 520 and then up the lysimeter fluid conduit 530.

In use, the fluid coupler 70' may be positioned with the threads 84 downward, and the first longitudinal portion 76 upward. Thus, sampled subsurface liquids will collect in a lower portion 522 of the reservoir 520, proximal to the threads 84. The lysimeter fluid conduit 530 may be in fluid communication with the lower portion 522 of the reservoir 520. The lysimeter fluid conduit 530 may pass through the cavity 80 of the fluid coupler 70', and up through the second fluid passageway 92 to a location above ground. It will be understood that the lysimeter fluid conduit 530 may pass through the first fluid passageway 91, or through an alternate aperture through the fluid coupler 70'.

Figure 10B:
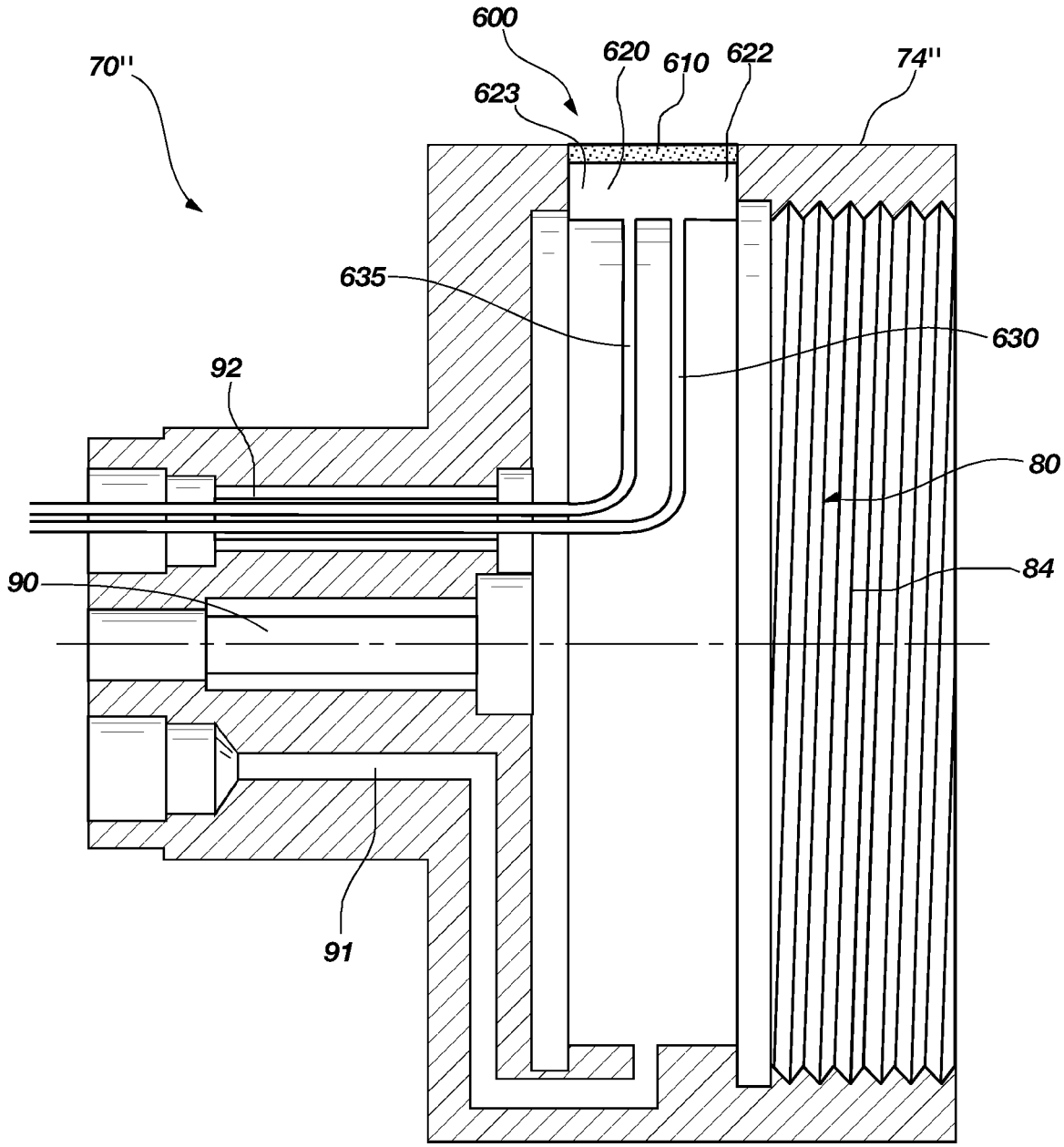
FIG. 10B is another view of the in situ reactor of FIG. 10A.

FIG. 10B depicts a double-tube suction lysimeter 600 within a fluid coupler 70". The double-tube lysimeter 600 may include a porous membrane 610, substantially contiguous with an outside facing surface 74" of the fluid coupler 70". A reservoir 620 may be positioned within the fluid coupler 70", with the porous membrane 610 comprising one boundary thereof. In use, subsurface liquids (not shown) may pass through the porous membrane 610 and collect in the reservoir 620. A sipper conduit 630 and an air conduit 635 may be coupled in fluid communication with the reservoir 620. The air conduit 635 extends from above ground to an upper region 623 of the reservoir 620. The sipper conduit 630 may extend into a lower region 622 of the reservoir 620. A vacuum may be drawn on the air conduit 635 to draw the subsurface liquids through the porous inside wall 610 and into the reservoir 620. Positive air pressure may then be applied to the reservoir 620 through the air conduit 635, forcing the liquid collected in the reservoir 620 up through the sipper conduit 630 to a higher elevation, for example, above ground. The sipper conduit 630 and the air conduit 635 may pass through the second fluid passageway 92 of the fluid coupler 70" to a location above ground. Alternatively, the air conduit 630 and sipper conduit 635 may pass through the first fluid passageway 91 or another aperture may be provided through the fluid coupler 70" for communication to a higher elevation.

Optionally, a suction lysimeter (not shown) for collecting liquid samples from the geological strata 11 surrounding the in situ reactor 10 may be provided on any outside facing surface of the in situ reactor 10, including in the liner 20. Returning to FIG. 5, the outside facing surface 24 of the main body 21 of the liner 20 may include a porous membrane substantially contiguous therewith. A reservoir may be positioned in the passageway 29, between the sampling conduit 30 and the inside facing surface 25 of the liner 20. The suction lysimeter may only partially circumferentially surround the sampling conduit 30, providing fluid communication through the passageway 29, between the first fluid passageway 91 of the fluid coupler 70 and the reactor space 36, via the one or more apertures 37 (FIG. 1) At least one lysimeter fluid conduit may be provided through the first fluid passageway 91 of the fluid coupler 70.

Figure 11:
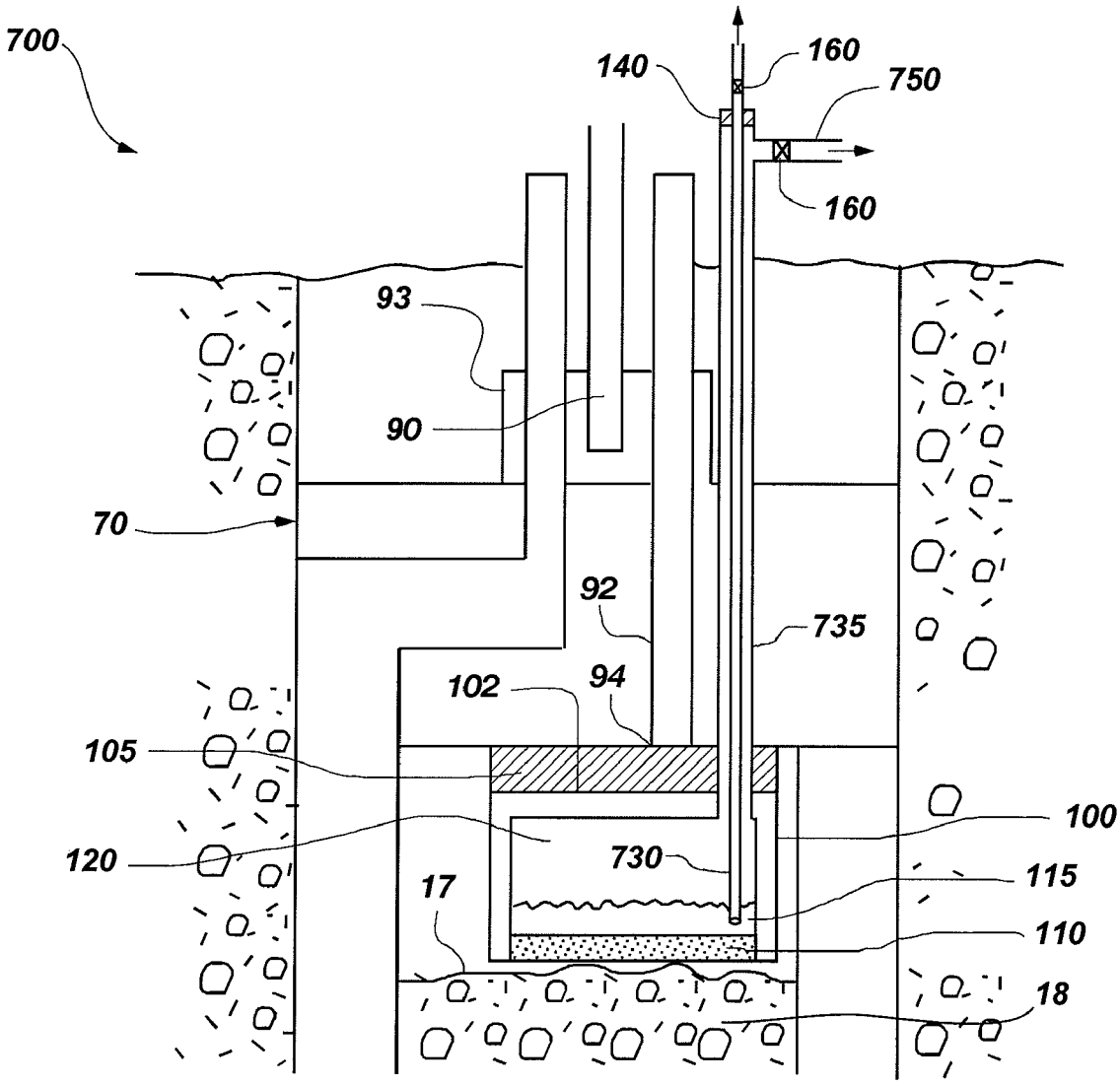
FIG. 11 is a partial cross-sectional view of an in situ reactor including a double-tube suction lysimeter according to an additional embodiment of the invention.

FIG. 11 depicts another double-tube suction lysimeter 700. The suction lysimeter 700 is a tube-in-tube configuration. The double-tube suction lysimeter 700 includes a porous membrane 110 through which subsurface liquids may be sampled. The porous membrane 110 may partially define a reservoir 120 in which sampled subsurface liquids 115 from the geological specimen 18 may collect. An air conduit 735 extends from above ground to the top surface of the double-tube suction lysimeter 700. A sipper conduit 730 may be telescopically received within the air conduit 735 and extend from within the air conduit 735 into a lower region of the reservoir 120. The sipper conduit 730 may enable the delivery of the sampled subsurface liquids 115 collected in the reservoir 120 to a location above ground for testing. The air conduit 735 and the sipper conduit 730 may pass through an opening in the fluid coupler 70, as shown, or the air conduit 735 and the sipper conduit 730 may be telescopically received within the second fluid passageway 92 of the fluid coupler 70.

Above ground, the air conduit 735 may include a seal 140 about the sipper conduit 730 enabling the liquids 115 within the sipper conduit 730 to be collected. The seal 140 extends from the outside perimeter of the sipper conduit 730 to the inside perimeter of the air conduit 735, sealing the end of the air conduit 735. An access tube 750 extends radially from the air conduit 735. The access tube 750 is in fluid communication with the air conduit 735. An operable sealing mechanism 160, for example a valve, may be operably connected with the sipper conduit 730 and the access tube 750, enabling fluid communication therethrough to be controlled.

OPERATION

The in situ reactor 10 may be placed in a borehole 15 using rotational or linear force, as described hereinabove. A geological specimen 18 may be drawn into the reactor space 26 within the sampling conduit 30. The liner 20 laterally isolates the geological specimen 18 from the surrounding geological strata 11. Test fluid, for example a treatment fluid for treatment of contamination at a site, may be introduced to the geological specimen 18 through the first fluid passageway 91. The suction lysimeter 100, 200, 300 may be used to sample the fluids of the geological specimen 18, for example, the soil pore water, before, during, and after the introduction of the test fluid.

Figure 12:
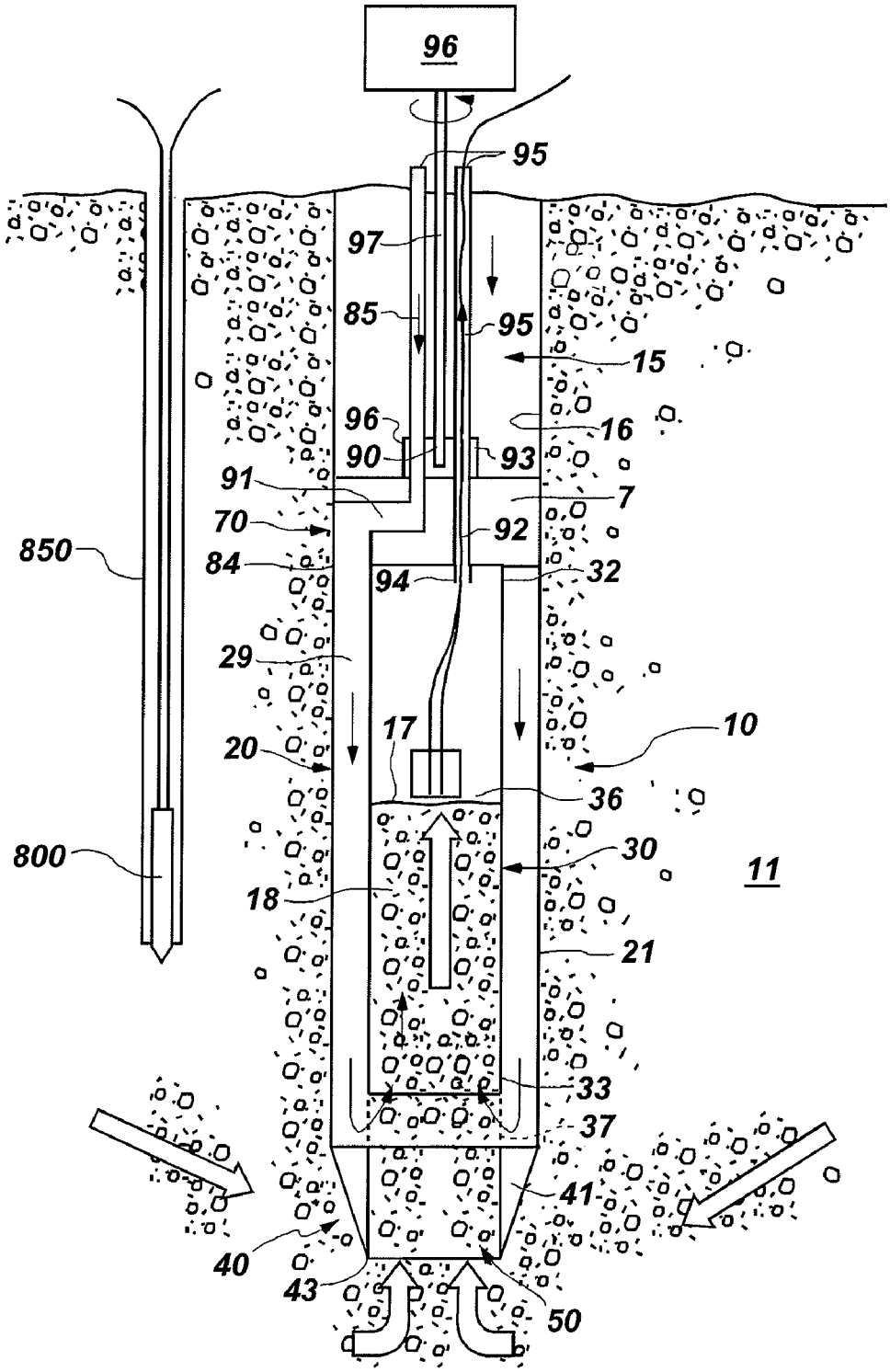
FIG. 12 is a cross-sectional view of the in situ reactor of FIG. 1 and a lysimeter also employed at a location below ground.

In another method of operation, depicted in FIG. 12, the in situ reactor 10 may be used in conjunction with an adjacent lysimeter 800. The lysimeter 800 may be deployed in the geological strata 11 adjacent the in situ reactor 10. The lysimeter 800 may be disposed within a borehole 850. The lysimeter 800 may comprise any suitable type of lysimeter, for example, a spike-shaped suction lysimeter, a suction lysimeter with a planar membrane, or a suction lysimeter with a cup-shaped membrane. A single-tube or a double-tube suction lysimeter may be used. The lysimeter 800 may be positioned within the geological strata 11, at a similar depth to the geological specimen 18. Alternatively, the lysimeter 800 may be used to collect sample fluids from a greater or a lesser depth than the geological specimen 18.

The in situ reactor 10 of the present invention may be useful for testing cleanup methods for contaminated soil. The underground testing site may remain undisturbed, and lab-scale investigation may be conducted on location. Fluids may be added to the geological specimen 18 via the first fluid passageway 91, and the soil pore water may be sampled and tested both within the geological specimen 18 via a suction lysimeter 100, 200, 300, 400 within the in situ reactor 10, and the soil pore water of the geological strata 11 surrounding the geological specimen 18 may be tested via a lysimeter 800 disposed adjacent the in situ reactor 10. Thus, the effect of the treatments (for example, the fluid added via the first fluid passageway 91) on the geological specimen 18 may be tested, and control testing may be preformed in real time on the surrounding geological strata 11.

Although the foregoing description contains many specifics, these should not be construed as limiting the scope of the present invention, but merely as providing illustrations of some exemplary embodiments. Similarly, other embodiments of the invention may be devised that do not depart from the spirit or scope of the present invention. Features from different embodiments may be employed in combination. For example, any of the suction lysimeters 100, 200, 300, 400 may include a semi-rigid surface 105 thereon. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

What is claimed is:

1. An in situ reactor for use in a geological strata, comprising:

a liner;

a sampling conduit received within the liner, the sampling conduit and the liner defining a passageway therebetween, and the sampling conduit defining a reactor space therein, wherein the sampling conduit includes an opening sized and configured to receive a geological specimen comprising soil, sediment or other matrix into the reactor space, and wherein the reactor space is in fluid communication with the passageway;

a fluid coupler borne by the liner and disposed in fluid communication with both the passageway and the reactor space, wherein the fluid coupler has a main body defining a cavity and is releasably coupled with the liner, and wherein the main body of the fluid coupler has a first fluid passageway formed therein and disposed in fluid communication with the passageway, and a second fluid passageway in fluid communication with the reactor space; and a lysimeter comprising a reservoir at least partially defined by a porous membrane disposed in fluid communication with the reactor space.

2. The in situ reactor of claim 1, wherein the porous membrane is generally planar.

3. The in situ reactor of claim 1, wherein the porous membrane is cup-shaped.

4. The in situ reactor of claim 1, wherein the lysimeter comprises an elongated annular member with a cylindrical tip and the porous membrane is configured to be received by the geological specimen.

5. The in situ reactor of claim 1, wherein the porous membrane comprises one of a ceramic material and a stainless steel material.

6. The in situ reactor of claim 1, wherein the lysimeter includes at least one conduit for delivery of a sampled fluid, the at least one conduit at least partially disposed within the second fluid passageway of the fluid coupler.

7. The in situ reactor of claim 6, wherein the lysimeter further comprises a second conduit in fluid communication with the reservoir.

8. The in situ reactor of claim 1, wherein the lysimeter includes at least one conduit for delivery of a sampled fluid, the at least one conduit at least partially disposed within an aperture through the main body of the fluid coupler.

9. The in situ reactor of claim 8, wherein the lysimeter further comprises a second conduit in fluid communication with the reservoir.

10. A method of testing the effect of a treatment on a contaminant in a geological strata, comprising:

positioning an in situ reactor within the geological strata, comprising:

applying a force to the in situ reactor, a liner and a sampling conduit disposed concentrically therewithin, and driving the liner and the sampling conduit in unison to a depth;

receiving a geological specimen, derived from the geological strata, within the sampling conduit; and providing a lysimeter comprising a reservoir and a porous membrane in contact with the geological specimen in the sampling conduit;

providing another lysimeter with a porous membrane in contact with the geological strata, at a location adjacent the in situ reactor;

taking at least a first sample of a fluid of the geological specimen with the lysimeter;

taking at least a first sample of a fluid of the geological strata with the another lysimeter;

introducing a treatment fluid to the geological specimen;

taking at least a second sample of the fluid of the geological specimen with the lysimeter; and taking at least a second sample of the fluid of the geological strata with the another lysimeter.

11. The method of claim 10, wherein introducing the treatment fluid to the geological specimen comprises introducing the treatment fluid through a first fluid passageway within a fluid coupler, the fluid coupler borne by the liner and having a second fluid passageway in communication with the sampling conduit.

12. The method of claim 11, wherein the taking at least the first sample of a fluid of the geological specimen with the lysimeter comprises transporting the at least the first sample through a sipper conduit disposed within the second fluid passageway of the fluid coupler.

13. The method of claim 12, wherein transporting the at least the first sample through the sipper conduit comprises drawing the at least the first sample through the sipper conduit using a vacuum.

14. The method of claim 12, wherein transporting the at least the first sample through the conduit comprises forcing the at least the first sample through the sipper conduit using positive pressure introduced through an air conduit in fluid communication with the sipper conduit.

15. The method of claim 10, wherein providing another lysimeter comprises providing another lysimeter that is an integral part of the in situ reactor.

16. An in situ reactor, comprising:

a liner having a main body defining a passageway therein;

a sampling conduit received within the passageway, wherein the sampling conduit defines a reactor space operable to receive a geological specimen therein;

a fluid coupler disposed with a first fluid passageway therethrough in fluid communication with the passageway defined by the liner, and a second fluid passageway in fluid communication with the reactor space of the sampling conduit; and a lysimeter in communication with the reactor space of the sampling conduit, wherein the lysimeter comprises:

a body;

a porous membrane secured to the body and in fluid communication with the reactor space;

a reservoir defined by the body and the porous membrane; and a sipper conduit in fluid communication with the reservoir and extending from the body through the fluid coupler.

17. The in situ reactor of claim 16, wherein the porous membrane comprises a substantially planar, round disc.

18. The in situ reactor of claim 16, wherein the porous membrane is cup-shaped.

19. The in situ reactor of claim 16, wherein the lysimeter body is elongated, and further comprises a conical tip.

20. The in situ reactor of claim 16, wherein the lysimeter further comprises an air conduit in fluid communication with the reservoir and extending from the body through the fluid coupler.

21. An in situ reactor for use in a geological strata, comprising:

a body having an outside facing surface, the body comprising:

a liner defining a passageway therein;

a fluid coupler, which is disposed with a first fluid passageway therethrough, in fluid communication with the passageway defined by the liner; and a lysimeter including a porous membrane substantially contiguous with the outside facing surface; and a sampling conduit received within the liner; and wherein the sampling conduit defines a reactor space therein and includes an opening sized and configured to receive a geological specimen comprising soil, sediment or other matrix into the reactor space; and wherein the reactor space of the sampling conduit is in fluid communication with a second fluid passageway through the fluid coupler.

22. The in situ reactor of claim 21, wherein the lysimeter is coupled to the fluid coupler.

* * * * *

UNITED STATES PATENT AND TRADEMARK OFFICE

CERTIFICATE OF CORRECTION

PATENT NO. : 7,617,742 B2
APPLICATION NO. : 11/424004
DATED : November 17, 2009
INVENTOR(S) : Radtke et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 608 days.

Signed and Sealed this

Fourteenth Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,617,742 B2
APPLICATION NO. : 11/424004
DATED : November 17, 2009
INVENTOR(S) : Corey W. Radtke, D. Brad Blackwelder and Joel M. Hubbell It is certified that error appears in the above-identified patent and that said Letters Patent is hereby corrected as shown below:

COLUMN 11, LINE 16, change "end 84" to --end 87--

Signed and Sealed this
Seventh Day of June, 2011

David J. Kappos

David J. Kappos
*Director of the United States Patent and Trademark Office*